US012595573B2

(12) United States Patent
Zendehdel et al.

(10) Patent No.: US 12,595,573 B2
(45) Date of Patent: Apr. 7, 2026

(54) ELECTROCATALYTIC METHOD AND APPARATUS FOR THE SIMULTANEOUS CONVERSION OF METHANE AND $CO_2$ TO METHANOL THROUGH AN ELECTROCHEMICAL REACTOR OPERATING AT ORDINARY TEMPERATURES AND PRESSURES, INCLUDING AMBIENT ONES

(71) Applicant: IRITALY TRADING COMPANY S.R.L., Rome (IT)

(72) Inventors: Mahmoud Zendehdel, Rome (IT); Narges Yaghoobi Nia, Rome (IT)

(73) Assignee: IRITALY TRADING COMPANY S.R.L., Rome (IT)

( * ) Notice: Subject to any disclaimer, the term of this patent is extended or adjusted under 35 U.S.C. 154(b) by 957 days.

(21) Appl. No.: 17/779,570

(22) PCT Filed: Dec. 11, 2020

(86) PCT No.: PCT/IT2020/000080
§ 371 (c)(1),
(2) Date: May 25, 2022

(87) PCT Pub. No.: WO2021/117071
PCT Pub. Date: Jun. 17, 2021

(65) Prior Publication Data

US 2023/0011619 A1 Jan. 12, 2023

(30) Foreign Application Priority Data

Dec. 12, 2019 (IT) ..... 102019000023760

(51) Int. Cl.
*C25B 3/07* (2021.01)
*C25B 3/26* (2021.01)
(Continued)

(52) U.S. Cl.
CPC ..... *C25B 3/07* (2021.01); *C25B 3/26* (2021.01); *C25B 9/19* (2021.01); *C25B 9/63* (2021.01);
(Continued)

(58) Field of Classification Search
None
See application file for complete search history.

(56) References Cited

U.S. PATENT DOCUMENTS

2008/0283411 A1* 11/2008 Eastman ..... C10G 2/30 205/343
2010/0086824 A1* 4/2010 Homel ..... C25B 9/70 429/406
(Continued)

FOREIGN PATENT DOCUMENTS

CA 2812031 A1 3/2012
WO 2008134871 A1 11/2008
(Continued)

OTHER PUBLICATIONS

Ryan P. Jansonius, Lacey M. Reid, Carolyn N. Virca, and Curtis P. Berlinguette ACS Energy Letters 2019 4 (4), 980-986 DOI: 10.1021/acsenergylett.9b00191 (Year: 2019).*
(Continued)

*Primary Examiner* — Louis J Rufo
(74) *Attorney, Agent, or Firm* — Jose Cherson Weissbrot

(57) ABSTRACT

Electrocatalytic apparatus for the simultaneous conversion of methane and $CO_2$ into methanol via an electrochemical reactor operating at ambient temperature and pressure, said electrochemical reactor simultaneously converts $CO_2$ to methanol by surficial catalytic reaction on the cathode, and methane to methanol by surficial catalytic reaction on the anode. The electrochemical reactor further works with an electrolyte consisting of electrolytic complexes of water-
(Continued)

Figure 1:
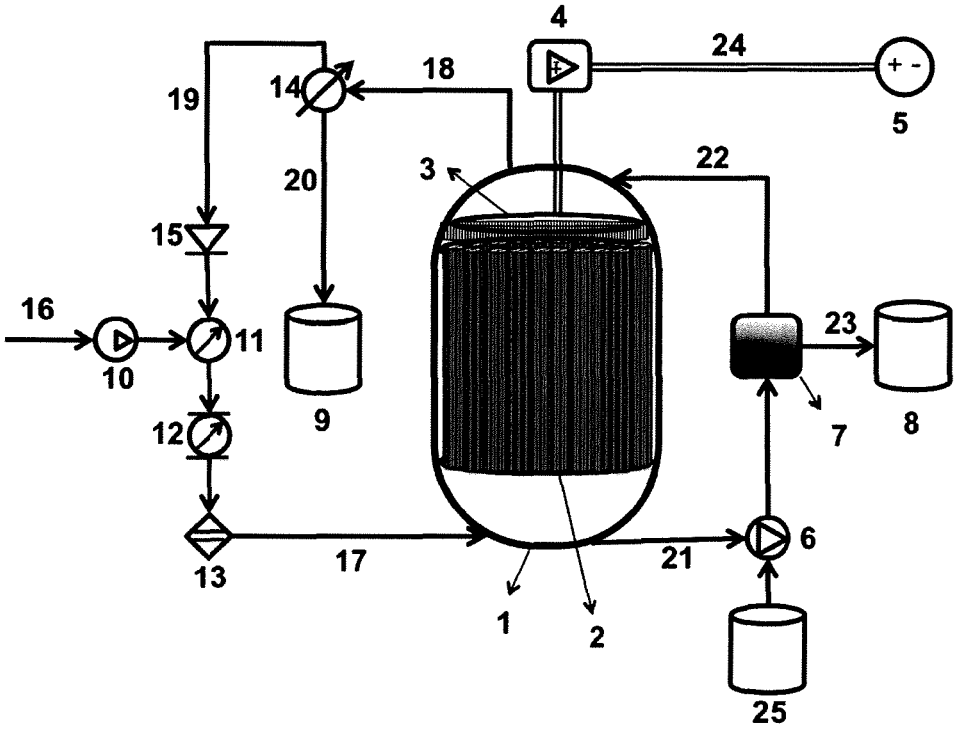

soluble transition metals and small molecules as co-catalyst of the electrocatalytic reactions and facilitator of ionic transfer and solubility of $CO_2$ and $CH_4$ molecules in the electrolyte. The electrochemical reactor is further equipped with zero-gap membrane electrocatalytic electrode assemblies, the cathode and anode comprising two electrocatalytic mesoporous surfaces and being tubular and coaxial, delineating two regions, which are separated one from the other by an ion exchange membrane (27). The tubular electrodes pack vertically together, the external gaps being filled by an insulating material. The packed electrodes are electrically connected to the power source in a parallel electrical circuit.

9 Claims, 1 Drawing Sheet

(51) Int. Cl.

| | |
|---|---|
| ***C25B 9/19*** | (2021.01) |
| ***C25B 9/63*** | (2021.01) |
| ***C25B 11/031*** | (2021.01) |
| ***C25B 13/04*** | (2021.01) |
| ***C25B 15/031*** | (2021.01) |

(52) U.S. Cl.
CPC ..... *C25B 11/031* (2021.01); *C25B 13/04* (2013.01); *C25B 15/031* (2021.01)

(56) References Cited

U.S. PATENT DOCUMENTS

| | | | |
|---|---|---|---|
| 2013/0288150 | A1 | 10/2013 | Hodges et al. |
| 2018/0214945 | A1 | 8/2018 | Chou et al. |
| 2019/0055656 | A1 | 2/2019 | Kenis et al. |

FOREIGN PATENT DOCUMENTS

| | | | |
|---|---|---|---|
| WO | 2009039325 | A2 | 3/2009 |
| WO | 2012166997 | A2 | 12/2012 |
| WO | 2019166999 | A1 | 9/2019 |
| WO | 2019215247 | A1 | 11/2019 |

OTHER PUBLICATIONS

Li, Q., et al. "Tuning Sn-Catalysis for Electrochemical Reduction of CO 2 to CO via the Core/Shell Cu/SnO 2 Structure", Journal of the American Chemical Society, https://pubs.acs.org/doi/10.1021/jacs.7b00261, vol. 139, Issue No. 12, Mar. 14, 2017, (Abstract only).

* cited by examiner

ELECTROCATALYTIC METHOD AND APPARATUS FOR THE SIMULTANEOUS CONVERSION OF METHANE AND $CO_2$ TO METHANOL THROUGH AN ELECTROCHEMICAL REACTOR OPERATING AT ORDINARY TEMPERATURES AND PRESSURES, INCLUDING AMBIENT ONES

The present invention relates to a process and an apparatus which differ from those known for an electrochemical approach for the direct, surficial and simultaneous conversion of carbon dioxide ($CO_2$) and methane gas in methanol through an electrocatalytic reaction which does not require high pressure and temperature values but it also operates at room temperature, at low energy, safeguarding high operational and production quality. The main part of the process operates in an electrochemical reactor, consisting of a array of tubular zero-gap membrane electrodes where, in each tubular electrode, the core side cathode electrode constituting the "catholyte" operates, and in the shell side it operates the anode constituting the "anolyte". The two compartments are separated from each other by an ion exchange membrane. The external surface of the anode covers by insulating coating. The tubular electrodes packed vertically together without any gap (the external gaps fills by insulating material). The packed electrodes electrically connect to the power source in a parallel electrical circuit in which the anode and cathode parts of each electrode connect to the anode and cathode of other packed electrodes, respectively and the final joint of anodes and cathodes connect to the power source.

The electrodes consist of an innovative combination of robust electrocatalysts and material (abundantly available in nature) with high porosity to obtain a high absorption of gas fractions and permeability toward flowing of the electrolyte from bottom to top of each packed electrode.

An aqueous-based electrolyte comprising homogeneous co-catalysts and small molecules circulates through the reactor and flows through the mesoscopic structure of the catholyte and anolyte without any separating flow line.

A stream of atmospheric air and/or flow of $CO_2$-rich gas flows into the reactor via an air compressor. Any natural gas and/or methane resource flow into the reactor solution simultaneously or as mixture with $CO_2$ stream without any limitation to presence of other gaseous (e.g., $O_2$, CO, $NO_x$, $SO_x$, $H_2S$, $N_2$) and/or vaporized (e.g., $H_2O$, mercaptans, hydrocarbons, solvents) moieties in the internal gaseous feedstock.

The reactor works by applying a DC polarization potential between two parts of electrodes. The gaseous $CO_2$ is capturing in the electrolyte and is selectively reduced to methanol through a surficial electrocatalytic reduction on the cathode surface. The methane gas also dissolves physically in the electrolyte and oxidizes selectively in methanol through a surficial electrocatalytic oxidation reaction on the anode surface. The produced methanol is being separated from the vapor and liquid phases by a condenser and methanol dehydration membrane system, respectively. The reactor can continuously produce methanol from $CO_2$ and methane, simultaneously or individually.

The apparatus operates at room temperature and atmospheric pressure in a closed circuit mode and does not release bypass products or contamination, so it can be classified as a totally ecological approach to carbon capture, utilization and storage (CCUS) and production of green fuel.

The present invention, with the proposed method and apparatus that work with the use of mixture gas flows of methane and $CO_2$ as feedstock for continuous production and in a phase of liquid methanol, is part of the Innovation research background to win the challenge that our planet is facing due to global warming, climate change and air pollution.

It needs to reduce greenhouse gas emissions but at the same time provide solutions that prevent the exhaustion of our resources and provide sustainable energy solutions and guarantee global energy demand.

The capture of $CO_2$ from the atmosphere or from energy-intensive industries may not only compensate for global warming, but, more importantly, it could help mitigate the climate change feedback processes that are responsible for amplifying the effect of $CO_2$ climatic forcing (e.g., the specific chain of effects due to environmental $CO_2$ can be altered by the presence of enormous quantities already released into the atmosphere).

The conversion of captured $CO_2$ into renewable fuels and valuable chemicals, mainly green fuels, is one of the main research trends for large-scale future development to reduce greenhouse gas emissions. Methane gas is an important source of clean and effective alternative energy that is not only a major component of natural gas resources, but can also easily be produced from some renewable energy sources such as biogas and the compost waste digestion process. However, the gaseous nature of this molecule can affect the application and transport of structures. As a result, methanol is the main product of the mild oxidation reaction of methane, which occurs in the liquid phase. It is interesting to note that methanol is an important precursor for the production of a wide range of petrochemical compounds. Today, over 90 production facilities are in operation worldwide, with a combined production capacity of approximately 110 million metric tones per year. Methanol and its derivative products such as acetic acid and formaldehyde created by chemical reactions are used as base materials in acrylic plastic; synthetic fabrics and fibers used to make clothes; adhesives, paints and plywood used in construction; and as a chemical agent in pharmaceutical and chemical products. Methanol also contains numerous physical properties, which makes it ideal for the transport sector. It has the ability to reduce carbon monoxide, hydrocarbon and azotoxic emissions compared to gasoline. Energy demand, which accounted for about 45% of total demand.

Methanol is the simplest alcohol with a density of 0.794 $g \cdot cm^{-3}$ and a boiling point of 65° C., while it can be classified as a fuel for clean combustion with a high heating value of 22.9 Mj/kg. At the moment, most of the methanol producers use SMR technology for the production of methanol from natural gas (EP0448019, US20060235090, JPH04217635, EP2404888, U.S. Pat. No. 4,277,416, EP2021309). SMR is a multi-step procedure briefly, i) natural gas reacts with steam on a nickel catalyst to produce syngas ($CO+H_2$) at 40 bar and 850° C., ii) the syngas then reacts on a mixture of catalyst ($Cu/ZnO/Al_2O_3$) to produce methanol at 50-100 bar and reactor conditions 250° C.

Various renewable sources of raw materials such as biomass have been introduced as an alternative to natural gas, but in the case of methanol from $CO_2$ the most illustrated plant is in Iceland (George Olah Renewable Methanol Plant) with an annual production of 4000 tons of methanol capturing 6000 tons of $CO_2$/year. The plant consists of modular units for the compression of synthesis gas and $CO_2$, capture of coal from steam turbines, electrolytic production of hydrogen (alkaline-water electrolyzer), direct synthesis from $CO_2$ to methanol and distillation for fuel to methanol.

However, the water splitting reaction of this plant consumes about 150 MWh of electricity, generated by renewable geothermal energy sources.

On the other hand, good procedures require high costs and high energy. U.S. Pat. No. 4,374,288 describes the combination of methane and oxygen in a high-energy electromagnetic field strong enough to atomize oxygen for combination with methane. UK. Tap. 1.244.001 describes the oxidation of methane on a catalyst ($Mo_2O_3$) $Fe_2O_3$ supported on silica/aluminum at high temperature and pressure. Similarly, in the U.S. Pat. No. 5,220,080 shows catalytic oxidation of methane using a surface oxide catalyst on a support of silica, alumina, magnesia, titania or zirconia metal oxide.

Consequently, there are other methods for the direct synthesis of methanol from methane gas, but due to the limitation of the methods, they seem far from the industrial scales. DE. Tap. 10006696A1 shows the direct synthesis of methanol from water and methane includes the production of cavitation in the water-methane mixture, giving a mixture of water and methanol. The use of powerful ultrasound generators could activate cavitation.

Sherman et al. (U.S. Pat. No. 6,328,854 B1) and Gonzalez-Martin et al. (U.S. Pat. No. 6,156,211) used photocatalytic methods for the production of active oxygen species and finally the photochemical oxidation of methane in methanol. However, all the photocatalytic processes related to this purpose are limited to the use of transparent glass lines and also to different types of irradiation. Furthermore, in this type of Advance Oxidation Process (AOP) the control of the oxidation reaction to prevent some other side reactions is always a great challenge.

In a patent (FR2944716A1), Lu invented a catalyst and a process for the electrochemical oxidation of methane to methanol or CO, however it seems that the low selectivity of the reaction to methanol has led to the production of $CO_2$. Furthermore, the use of noble metals such as platinum and ruthenium as the main element of its proposed catalyst constitutes a challenge for the large-scale commercialization of the invention.

In another invention, Serrano Ruiz et al. (ES2599382B1) has developed an invention for the electrochemical reduction of $CO_2$ in methanol. In their invention they not only used noble metals (iridium) as the core of electrocatalysts, but also performed the reaction at more than 70° C.

On the other hand, Teamey et al. (U.S. Pat. No. 8,845,875B2) has introduced a system for the electrochemical reduction of $CO_2$ with the co-oxidation of an alcohol. In their invention they use an alcohol in addition to $CO_2$ as a raw material for the production of two not mentioned products using at least one of rare elements of ruthenium, iridium, platinum or gold.

In another innovation, Eastmen et al. [WO2008/134871A1] presented an electrochemical reactor for production of hydrocarbons from carbon and hydrogen sources. Accordingly, they realized a horizontal array of the cylindrical electrodes with separate carbon-rich gas flow from inside and electrolyte flow through outside of the electrodes. The gaseous feeds blow separately through the interior cathodic part which present a type of gas-diffusion electrode. The reported patent performs indirect $CO_2$ reduction through i) electrocatalytic water splitting (similar to the electrolyzer) by using of some scarce elements e.g., platinum, ruthenium and iridium as main electrocatalysts of the electrodes and ii) reaction of anodic formed hydrogen ions in the cathode to form hydrocarbons (without any selectivity to a specified product). However, such systems always encounter to various obstacles toward commercialization due to 1) high electricity consumption of water splitting, 2) complexity and high-cost reactor design with separated parts of gaseous and electrolyte feedstocks, 3) low selectivity of the products, and 4) utilization of scarce materials.

Similarly, Wayne et al. (WO2012/166997A2) reported an innovative electrochemical system for increase mass transport rates of materials to and from the surfaces of electrodes. Accordingly, they reported a gas-diffusion cathode with separate channels of gaseous feedstocks and electrolyte. Furthermore, they used some ionic compounds and redox mediators in the electrolyte in order to facilitate the ionic transport between electrodes without any additional catalytic activity for enhancement the selectivity of the reaction or solvability of gaseous moieties like $CO_2$. However, such electrochemical systems need to realize heavy and complex reactors for separation of gas streams from liquid electrolyte.

Stankovski et al. (WO 2009/039325 A2) realized a methods and apparatus for the activation of a low reactivity, non-polar chemical compound such as $CO_2$ to produce some useful chemicals such as formaldehyde and electrocatalytic oxidizing of aromatic compounds to oxidized products. At least one of (a) an oxidizing agent or a reducing agent, and (b) a polar compound is provided to the catalyst and the chemical compound. However, the $CO_2$ reduction of this invention is based on chemical reaction of $CO_2$ and $H_2$ which need to be provided from another reaction (such as water splitting) and from out of the reactor. Furthermore, requirement for addition oxidizing reagents and utilization of some scarce elements such as platinum in the electrocatalysts are another shortcoming of this system which led to complicated commercialization.

Hosseini et al. (WO2019/166999A1) are disclosed an array of silicon-based electrocatalysts for multi-electron electrochemical oxidation or reduction. Despite its merit about high performance decorated silicon-based substrates and its cost-effective, for realization of a selective electrochemical reaction, such substrates need to be supported by some scarce catalyst compounds which prevent their final interest for large scale industrial application.

On the other hand, Kenis et al. (US2019/0055656A1) are invented a system for electroreducing $CO_2$ to some added-value chemicals via utilization of a double gas-diffusion structure of electrodes (both cathode and anode) and additional chemical feedstocks of glycerol or glucose which need to be oxidized in anode. However, despite the reduced over-potential performance of the system which provided by oxidization of glycerol or glucose in the anode, commercialization of such systems needs to considering of some limitation which arise from complex design of the gas-diffusion electrodes and utilization of additional feedstocks.

Figure 2:
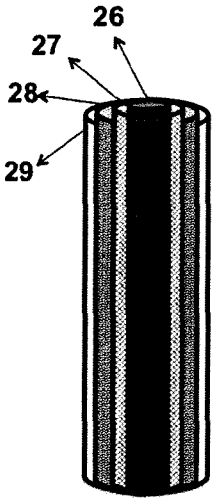
Figure 3:
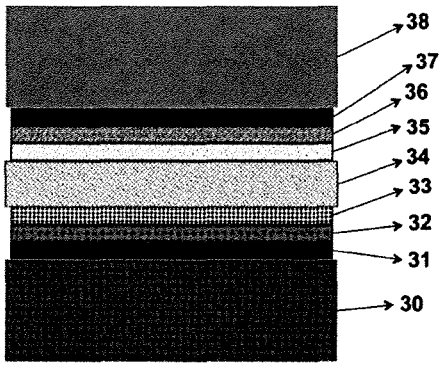
Figure 4:
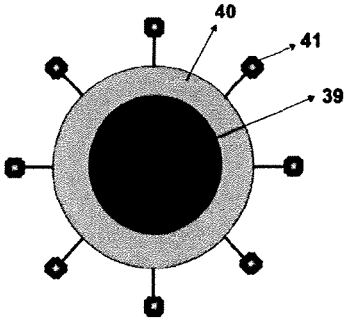

The invention will be described with reference to the attached table where:

FIG. 1 represents the apparatus that carries out the transformation method of methane and $CO_2$ in methanol with the reactor where the transformation takes place and the components for feeding the reagents, the electrolyte and the extraction of methanol, FIGS. 2, 3 and 4 details of the structure and mutual positioning of the electrodes and decorated nanocomposites.

The reactor of the present invention consists of electrodes connected in parallel and each electrode consists of two electrocatalytic regions, i.e. the catholyte and the anolite, which are separated from each other by an ion-exchange membrane.

The core of each electrode consists of a cathode which is formed by a layer by layer deposition of at least, but not limited to (non-binding limit), 3 p-type semiconductor films and/or conductive electro-active nanocomposites on a conductive surface.

A decorated (well combination of 3D nanostructures with 2D top layers and immobilized molecular catalysts) nanocomposites structure of fully earth abundant elements (not utilization of any amounts of rare-elements e.g., platinum, ruthenium, iridium, etc), are used as precursor of the p-type semiconductor films of cathode.

The 3D part of the decorated nanocomposites consists of earth-abundant elements including iron, copper, zinc, titanium, tungsten, zirconium, silicon, carbon and molybdenum in the structures including but not limited to, metal oxides, metal sulfides, metal nitrides, polyoxomethalates, aluminosilicates, metal organic frameworks, zeolitic imidazolate frameworks, hybrid organic-inorganic materials.

The 2D part of the decorated nanocomposites consists of earth-abundant materials including iron, copper, zinc, titanium, tungsten, zirconium, silicon, carbon and molybdenum in the structures including but not limited to, 2D transition metals carbides and nitrides (MXenes), organic polymers and co-polymers, inorganic polymers, grapheme or other 2D allotropes of carbon, carbon nanotubes (CNTs), 2D metal oxides and/or 2D metal sulfides.

The immobilized molecular catalysts on top of 3D/2D decorated nanocomposites consists of earth-abundant compounds in the structures including but not limited to, metal complexes, biomolecules and small organic molecules.

For example, the decorated 3D/2D/molecular nanocomposites may consist of polyoxometalates of the type Si/Mo/W/Cu, CuO/ZnO, $ZnFe_2O_4$, $ZnCo_2O_3$, natural doped aluminosilicates with polymers, carbon-doped carbon fibers, imidazolate zeolitic structures (ZIF), immobilized and modified enzymes, MXenes, structured phase of some oxides/sulphides/metal nitrides such as $WO_3$, ZnS, TiN, $TiO_2$, $SnO_2$ and FeS.

The layers are formed from inks and/or pastes and/or powders formulated from the decorated nanocomposites through different techniques including, but not limited to, dip-coating, sputtering, chemical vapor deposition, physical vapor deposition, blade coating, slot-die coating, spray coating, spray pyrolysis, magnetron sputtering, atomic layer deposition, chemical bath deposition, co-precipitation, hot pressing, powder coating, brush coating, sol-gel, electrochemical coating, self-assembly, mechanical stacking, photocatalytic formation and biocatalytic formation.

The first layer deposits as a compact nanoscale thicknesses (40-150 nm) and subsequently one or two mesoporous layers of the decorated nanocomposites materials deposits on the compact layer with microscale thicknesses (0.5-8 μm).

The decorated layer of the nanocomposites when deposits as mesoporous cathode surface can support polarization-induced piezopotential in addition a piezoelectrocatalytic effect to finally create a piezoelectrocatalyst in order to favour band bending and charge transfer kinetics of the electrode by using the piezopotential that create by electrolyte fluid through the mesoporous structure of the electrodes. In the piezoelectrocatalyst, external strain can generate a spontaneous internal electric field due to the presence of polarized charges. The surface energy level with positive polarization charge is downward bent throughout the domain, such that the surface will be at a higher potential compared with before. This case is beneficial for electron migration to the electrolyte, and its reduction ability is further enhanced. By contrast, with negative polarization charges, a potential is gained across the domain and the band is upward bent, thus the surface is at a lower potential than before. And in this case, the transfer kinetics of electroinduced electrons is suppressed for the increased energy barrier, while the hole transfer will be facilitated (but slightly reduces the reduction potential). In total, determined by the strength of internal electric field, different degrees of band bending obtained by tuning the direction/strength of applied strain can result in varied transfer kinetics of surface charges. Meanwhile the driving force (redox potential of charges) toward the surficial cathode reaction (reduction of $CO_2$ to methanol at surface of the cathode) in the electrolyte solution can also be manipulated.

The working functions of the porous layers in the cathodic part of the electrode are optimized to minimize the required electrical power of the redox reaction. The band structure of each layer is engineered to amplify the potential applicator and reduce the barrier to the electrochemical reaction by minimizing the activation energy of the rate determination step.

In the cathodic region, by applying the bias potential from electric source the decorated 3D/2D/molecular multilayer structure of the cathodic piezoelectrocatalysts catalyze selective reduction of the $CO_2$ to methanol through following surficial reaction mechanism:

$$2H_2O \rightarrow 4H^* + 4OH^- \quad 1)$$

$$CO_2 + H^* \rightarrow CO^* + OH^- \quad 2)$$

$$CO^* + 3H^* \rightarrow CH_3O^* \quad 3)$$

$$CH_3O^* + H_2O \rightarrow CH_3OH + OH^- \quad 4)$$

In order to improve the selectivity of the reaction towards methanol, the active redox complexes of abundant transition metals use as a co-catalyst of the cathodic reaction.

The composition layer by layer of the films produces an amplification effect due to the bias potential of performing the reaction under environmental conditions and low electrical power with high conversion efficiency.

The composition of the anode part of the electrode contains electro-active nanocomposites of the n-type semiconductor and conductor of at least, but not limited to, 3 films of earth-abundant elements.

A decorated (well combination of 3D nanostructures with 2D top layers and immobilized molecular catalysts) nanocomposites structure of fully earth abundant elements are used as precursor of the n-type semiconductor films of anode.

The 3D part of the decorated nanocomposites consists of earth-abundant elements including iron, copper, zinc, titanium, tungsten, zirconium, silicon, carbon and molybdenum in the structures including but not limited to, metal oxides, metal sulfides, metal nitrides, polyoxomethalates, aluminosilicates, metal organic frameworks, zeolitic imidazolate frameworks, hybrid organic-inorganic materials.

The 2D part of the decorated nanocomposites consists of earth-abundant materials including iron, copper, zinc, titanium, tungsten, zirconium, silicon, carbon and molybdenum in the structures including but not limited to, 2D transition metals carbides and nitrides (MXenes), organic polymers and co-polymers, inorganic polymers, grapheme or other 2D allotropes of carbon, carbon nanotubes (CNTs), 2D metal oxides and/or 2D metal sulfides.

The immobilized molecular catalysts on top of 3D/2D decorated nanocomposites consists of earth-abundant compounds in the structures including but not limited to, metal complexes, biomolecules and small organic molecules.

The anode layers are formed from inks and/or pastes and/or powders formulated from the decorated nanocomposites through different techniques including, but not limited to, dip-coating, sputtering, chemical vapor deposition, physical vapor deposition, blade coating, slot-die coating, spray coating, spray pyrolysis, magnetron sputtering, atomic layer deposition, chemical bath deposition, co-precipitation, hot pressing, powder coating, brush coating, sol-gel, electrochemical coating, self-assembly, mechanical stacking, photocatalytic formation and biocatalytic formation.

For example, the decorated 3D/2D/molecular nanocomposites of anode can be made with Si/W/Co-based of n-type polyoxometalates, $Co_2O_3$/ZnO, $Nb_2O_3$, $ZnSnO_3$, $MnO_2$, NiO, $ZnFe_2O_4$, $ZnCo_2O_3$, vanadium oxide, inorganic perovskites such as $CsPbX_3$, natural metal aluminosilicate metal structure, MOF and modified structured phase of some metal oxides/sulphides/nitrides such as $WO_3$, TiN, $TiO_2$, $SnO_2$ and ZnS.

The first layer deposits as a compact nanoscale thicknesses (40-150 nm) and subsequently one or two mesoporous layers of the decorated nanocomposites materials deposits on the compact layer with microscale thicknesses (0.5-8 μm).

Similar to the cathode, the decorated layer of the nanocomposites when deposits as mesoporous anode surface can support polarization-induced piezopotential in addition a piezoelectrocatalytic effect to finally create a piezoelectrocatalyst in order to favour band bending and charge transfer kinetics of the electrode by using the piezopotential that create by electrolyte fluid through the mesoporous structure of the electrodes. Accordingly, the driving force toward the surficial anode reaction (oxidation of methane to methanol at surface of the anode) in the electrolyte solution can also be manipulated. The working functions of the porous anode layers are aimed at minimizing the electrical power required for the oxidation reaction.

In the anodic region, by receiving the applied bias potential from electric source the decorated 3D/2D/molecular multilayer structure of the anodic piezoelectrocatalysts catalyze partial oxidation of the methane to methanol through following surficial reaction mechanism:

$$2H_2O \rightarrow 2OH^* + H^+ \quad 1)$$

$$CH_4 + OH^* \rightarrow CH^*_3 + H_2O \quad 2)$$

$$CH_3^* + OH^* \rightarrow CH_3OH \quad 3)$$

The formed active oxygen fractions react immediately with methane molecules in the space charge region of the anode and produce methanol.

The selectivity of this reaction also improves by using homogeneous co-catalysts of earth-abundant transition metal complexes.

The working function of the anodic layers is aimed at amplifying the polarization potential and improving the faradic efficiency in ambient environmental conditions.

The electrolyte consists of an aqueous solution of redox mediators and ion fractions for the control of electrochemical neutrality and pH of the reaction solution, Some complexes of water-soluble transition metals, including, by way of example, Schiff bases of Cu/Co/Cr, salens, salophen, chelates and metallocenes, as co-catalyst of the electrocatalytic reaction. The co-catalysts acts three separate roles at the same time namely, i) enhancement the solubility of the $CO_2$ and $CH_4$ in aqueous solution, ii) electrochemical stable and fast redox scuttles to facilitate the ionic transport inside the electrochemical regions, and iii) enhancement the selectivity of the surficial reactions toward formation of $CH_3O^*$ intermediate phase. However, the mentioned co-catalysts can also immobilized on the surface of the decorated 3D/2D piezoelectrocatalysts as well.

A threshold voltage of 0.8 V is required to start the electrochemical reaction and the total consumed electrical energy is relative to the reactor capacity.

A bipolar membrane consists of but not limited to organic and/or inorganic polymers composited with 2D MXenes nanoflakes installs between cathode and anode without any gap (zero-gap membrane structure) for maintain the electric neutrality of the reaction medium. Accordingly, the formed $OH^-$ and $H^+$ ions in the catholyte and anolyte mesostructure, respectively, can migrate through bipolar ion-selective membrane to maintain electrical neutrality of the electrochemical system.

FIG. 1 represents the apparatus that carries out the overall transformation process for the feeding phases of the cylindrical reactor 1, which can be constructed, for example, in polyethylene or glass or stainless steel or any corrosion-resistive coated metals, to extract and store the produced methanol.

The tubular electrodes 2 are arranged inside the reactor;

The electrodes are connected in parallel to the electric jointer 3, which is connected to a potentiostat/galvanostatic instrument 4;

The driving force of the electrochemical reaction is provided by a DC power source 5 through the wires 24;

The electrodes are permeable to pass gas and electrolyte on both sides;

Any type of gaseous raw material including atmospheric air, industrial $CO_2$-rich air, pure $CO_2$, natural gas, biogas and pure methane can be injected into the system through line 16 and using the compressor 10, individually and/or simultaneously as blend. The feed mixture can contain any gaseous (e.g., $O_2$, CO, $NO_x$, $SO_x$, $H_2S$, $N_2$) and/or vaporized (e.g., $H_2O$, mercaptans, hydrocarbons, solvents) moieties without any limitation;

The injected flow line is passed through the pressure regulator 11, the flow regulator 12 and the gas sensor 13 and blows to the reactor and mix with the electrolyte through the flow line 17;

The flow line 18 containing possible formed vaporized methanol, possible unreacted methane and $CO_2$ and other possible gaseous moieties of the injected feed, flow in the condenser 14 which led to the liquefaction of the vaporized methanol and transfer to the methanol storage tank 9 through the line 20;

On the other hand, the vapor phase of the condenser, bypasses into the system through line 19 passing through a one-way valve 15;

The reactor electrolyte circulates from pump 6, line 21 and line 22;

Any mixture of water including but not limited to the sea water, waste water from residential and industrial and agricultural sewage and fresh water from rivers and underground sources and dehumidification of atmospheric moisture, insert in the electrolyte reservoir 25;

The produced methanol in the liquid phase of the electrolyte is separated from the aqueous phase by the methanol separation membrane 7 and transferred to the methanol storage tank 8 through the line 23. The fresh electrolyte is stored in the storage tank 25 and injected into the reactor during production.

The methanol separation membrane 7 consists of two pervaporation hallow fiber membranes selective to methanol and water included but not limited to organic and/or inorganic polymers composited with 2D MXenes nanoflakes or 3D inorganic catalysts like zeolites and polyoxomethalates.

The internal structure of each packed tubular zero-gap membrane electrode is shown in FIG. 2.

The core 26 is related to the cathode, which is formed by the deposition of at least 3 p-type decorated semiconductor mesoporous films on a conductive surface;

The shell of the tubular electrode is structured by the anode 28, which is formed by the deposition of at least 3 n-type decorated semiconductor mesoporous films on a conductive surface;

The cathode and the anode are separated by an ion exchange membrane 27 without any physical gap between electrodes and the membrane. The conductive parts of the anode and the cathode are connected to the electrical joint 3;

The external surface of the anode covers by insulating coating 29. The tubular electrodes packed vertically together without any gap (the external gaps fills by insulating material). The packed electrodes electrically connect to the power source in a parallel electrical circuit in which the anode and cathode parts of each electrode connect to the anode and cathode of other packed electrodes, respectively and the final joint of anodes and cathodes connect to the power source.

The layer by layer structure of the tubular electrodes is shown in FIG. 3.

The zero-gap membrane tubular electrode is consists of a rod-like compact core 30 of cathode substrate which covered by a nanoscale compact film 31 of an earth-abundant p-type semiconductor and subsequently one and/or two microscale mesoscopic porous films 32 and 33 composited by decorated earth-abundant piezoelectrocatalysts of the cathode. A microscale film of ion-selective membrane 34 covers cathode without any gap between cathode and internal surface of the membrane;

The ion-selective membrane is designed by using of a composition of earth-abundant polymer/MXenes layers with bipolar structure and cation and anion exchange characteristic and non-permeability to methane and $CO_2$ molecules;

A tubular anode substrate 38 which consists of metallic flexible foil which internally covered by a nanoscale compact film 37 of a n-type semiconductor and subsequently one and/or two microscale mesoscopic porous films 35 and 36 composited by decorated earth-abundant piezoelectrocatalysts of the anode, cover on the ion-selective membrane 34 without any gap between anode and external surface of the ion-selective membrane;

The electrolyte including the mixture of gaseous feedstocks enter from bottom part of vertical electrodes and fluid through mesoscopic structure of both cathode and anode.

The structure of the decorated nanocomposites which utilized as precursor of piezoelectrocatalysts in the mesoscopic layers of the cathode and anode is shown in FIG. 4.

The decorated nanocomposites synthesize from fully earth abundant elements consists of a core 39 of 3D nanostructures which covered by a shell 40 of 2D nanostructures and immobilized molecular catalysts 41, uses as precursor of the mesoscopic films of the anode and cathode surfaces. The decorated 3D/2D/molecular structure of the nanocomposites can induce the piezoelectrocatalytic effect when deposit as mesoporous layers of cathode and anode surfaces. Furthermore, the decorated structure can markedly enhance the adsorption of the $CO_2$ and $CH_4$ molecules on the surface of cathode and anode, respectively. In addition, the decorated structure can improve the selectivity of the surficial reaction of $CO_2$ and $CH_4$ toward methanol (as a selective product) in the cathode and anode, respectively.

The performance of the process and of the apparatus described above (engineered) to subject it to different tests.

The design construction details adopted for carrying out the experimentation and showing the feasibility of the invention do not constitute a form of limitative embodiment of the method and of the related apparatus for which patent protection is requested.

It is used pure methane gas in capsules with a purity of 99% (sample M1), the natural residential distribution line with 80% of methane (sample M2) and biogas provided by the bacterial digestion of urban organic waste with about 60% of methane (sample M3) as methane-based raw materials. Furthermore, pure $CO_2$ gas as a capsule with 99% purity (sample C1), concentrated $CO_2$ flow from a cement production line with ~75% $CO_2$ (sample C2), a biogas flow from bacterial digestion of urban organic waste containing ~40% $CO_2$ (Sample C3) and normal atmospheric agricultural air containing ~400 ppm of $CO_2$ (sample C4), are used as carbon-based raw materials.

The quality and quantity of all the samples and gases contained are analyzed by sampling from the gas lines entering and leaving the reactor, using a portable gas analyzer with precise sensors for $CO_2$, $CH_4$, CO, $H_2$, $O_2$, $N_2$, $NO_2$, $SO_2$ and $H_2S$. The quantities of methanol produced in the liquid phases are analyzed by GC-Mass analysis. The faradic response of the reactor is controlled through the reaction by means of a potentiostat/galvanostate instrument and through chronopotentiocholometric (CPC) analysis.

The results of the electrocatalytic reaction are shown in the Table. The conversion is calculated based on the raw material for the incoming gas and the difference in the percentage of methane/$CO_2$ in any supply is not considered.

TABLE

Results of the electrocatalytic reaction for three methane-based samples and four $CO_2$-based samples as feedstock of the reactor.

| Number | Sample Feed | Conversion (%) | Selectivity (%) | Temperature (° C.) | Pressure (atm) | Time (min) |
|---|---|---|---|---|---|---|
| 1 | M1 | 69 | 65 | 25 | 1 | 15 |
| 2 | M1 | 88 | 83 | 25 | 1 | 30 |
| 3 | M1 | 91 | 87 | 25 | 1 | 45 |
| 4 | M1 | 93 | 91 | 25 | 1 | 60 |
| 5 | M1 | 97 | 94 | 25 | 1 | 90 |
| 6 | M2 | 38 | 35 | 25 | 1 | 15 |
| 7 | M2 | 51 | 45 | 25 | 1 | 30 |
| 8 | M2 | 59 | 54 | 25 | 1 | 45 |
| 9 | M2 | 68 | 60 | 25 | 1 | 60 |
| 10 | M2 | 75 | 64 | 25 | 1 | 90 |
| 11 | M3 | 40 | 36 | 25 | 1 | 15 |
| 12 | M3 | 47 | 42 | 25 | 1 | 30 |
| 13 | M3 | 54 | 49 | 25 | 1 | 45 |
| 14 | M3 | 62 | 52 | 25 | 1 | 60 |
| 15 | M3 | 69 | 60 | 25 | 1 | 90 |
| 16 | C1 | 34 | 30 | 25 | 1 | 15 |
| 17 | C1 | 52 | 48 | 25 | 1 | 30 |
| 18 | C1 | 67 | 59 | 25 | 1 | 45 |
| 19 | C1 | 79 | 70 | 25 | 1 | 60 |
| 20 | C1 | 96 | 91 | 25 | 1 | 90 |
| 21 | C2 | 29 | 24 | 25 | 1 | 15 |
| 22 | C2 | 48 | 39 | 25 | 1 | 30 |
| 23 | C2 | 60 | 45 | 25 | 1 | 45 |
| 24 | C2 | 73 | 56 | 25 | 1 | 60 |
| 25 | C2 | 82 | 61 | 25 | 1 | 90 |
| 26 | C3 | 30 | 22 | 25 | 1 | 15 |
| 27 | C3 | 45 | 33 | 25 | 1 | 30 |
| 28 | C3 | 51 | 39 | 25 | 1 | 45 |
| 29 | C3 | 64 | 48 | 25 | 1 | 60 |
| 30 | C3 | 71 | 55 | 25 | 1 | 90 |
| 31 | C4 | 17 | 15 | 25 | 1 | 15 |
| 32 | C4 | 29 | 25 | 25 | 1 | 30 |

TABLE-continued

Results of the electrocatalytic reaction for three methane-based samples and four $CO_2$-based samples as feedstock of the reactor.

| Number | Sample Feed | Conversion (%) | Selectivity (%) | Temperature (° C.) | Pressure (atm) | Time (min) |
|---|---|---|---|---|---|---|
| 33 | C4 | 48 | 40 | 25 | 1 | 45 |
| 34 | C4 | 60 | 52 | 25 | 1 | 60 |
| 35 | C4 | 67 | 60 | 25 | 1 | 90 |

The results show a high conversion efficiency in environmental conditions both for methane and $CO_2$ raw materials with a high selectivity of the electrocatalytic reaction toward methanol as a product.

What is claimed:

1. A piezo-electrocatalytic apparatus for the simultaneous conversion of methane and $CO_2$ into methanol, the apparatus comprising:

an electrochemical reactor configured to operate at a standard ambient temperature and pressure;

a plurality of zero-gap membrane piezo-electrocatalytic electrodes vertically packed within the electrochemical reactor, wherein each of the electrodes comprising:

a tubular, mesoporous cathode surface;

a tubular, mesoporous anode surface coaxial with the cathode surface; and an ion exchange membrane separating the cathode surface and the anode surface;

an insulating material filling external gaps between adjacent packed electrodes;

a power source electrically connected to the electrodes in a parallel circuit;

an electrolyte comprising an aqueous solution of redox mediators, ionic fractions, water-soluble transition metal complexes, and a co-catalyst, wherein the electrolyte is configured to flow from a bottom portion of the electrodes packed vertically through the cathode surfaces and the anode surfaces to a top portion thereof;

a gas inlet at bottom of the electrochemical reactor configured to introduce a gas mixture of methane and $CO_2$, wherein the flow of the electrolyte and dissolved gases through the cathode surface and the anode surface is configured to generate a piezopotential that reduces the electrical energy required from the power source, the cathode surface is structured to catalyze the direct, superficial reduction of dissolved $CO_2$ to methanol, and the anode surface is structured to catalyze the direct, superficial oxidation of dissolved methane to methanol.

2. The apparatus of claim 1, wherein the cathode surface is formed by a layered deposition on a conductive surface, the layered deposition comprising:

a compact layer having a thickness between 40-150 nm; and at least one mesoporous cathode layer deposited on the compact layer having a thickness between 0.5-8 μm and comprising a decorated nanocomposite material; wherein the decorated nanocomposite material comprises a combination of 3D nanostructures, 2D top layers, and immobilized molecular catalysts, and is configured to function as a p-type semiconducting piezoelectrocatalyst that enhances charge transfer kinetics for the reduction of $CO_2$.

3. The apparatus of claim 2, wherein the decorated nanocomposite material of the cathode surface comprises:

the 3D nanostructures selected from the group consisting of metal oxides, metal sulfides, metal nitrides, polyoxomethalates, aluminosilicates, metal organic frameworks, and zeolitic imidazolate frameworks;

the 2D top layers selected from the group consisting of 2D transition metal carbides and nitrides (MXenes), organic polymers, inorganic polymers, graphene, carbon nanotubes (CNTs), 2D metal oxides, and 2D metal sulfides; and an immobilized molecular catalysts selected from the group consisting of metal complexes, small organic molecules, and biomolecules.

4. The apparatus of claim 1, wherein the anode surface is formed by a layered deposition on a conductive surface, the layered deposition comprising:

a compact layer having a thickness between 40-150 nm; and at least one mesoporous anode layer deposited on the compact layer, wherein the at least one mesoporous anode layer having a thickness between 0.5-8 μm and comprising a decorated nanocomposite material;

wherein the decorated nanocomposite material comprises a combination of 3D nanostructures, 2D top layers, and an immobilized molecular catalysts, and is configured to function as an n-type semiconducting piezoelectrocatalyst that enhances charge transfer kinetics for the oxidation of methane.

5. The apparatus of claim 4, wherein the decorated nanocomposite material of the anode surface comprises:

the 3D nanostructures selected from the group consisting of metal oxides, metal sulfides, metal nitrides, polyoxomethalates, aluminosilicates, metal organic frameworks, and zeolitic imidazolate frameworks;

the 2D top layers selected from the group consisting of 2D transition metal carbides and nitrides (MXenes), organic polymers, inorganic polymers, graphene, carbon nanotubes (CNTs), 2D metal oxides, and 2D metal sulfides; and the immobilized molecular catalysts selected from the group consisting of metal complexes, small organic molecules, and biomolecules.

6. The apparatus of claim 1, wherein the direct, superficial reduction of CO2 at the cathode surface proceeds via the formation of H*, CO*, and CH3O* active intermediate moieties from H2O and CO2 molecules.

7. The apparatus of claim 1, wherein the direct, superficial oxidation of methane at the anode surface proceeds via the formation of OH* and CH3* active intermediate moieties from H2O and CH4 molecules.

8. The apparatus of claim 1, further comprising a feeding and extraction system, the system comprising:

a gas flow line for the gas mixture, wherein the gas flow line including a pressure regulator, a flow regulator, and a gas sensor;

an electrolyte circulation loop comprising a pump and an electrolyte reservoir;

a condenser fluidly connected to a vapour outlet of the reactor, wherein the condenser is configured to liquefy vaporized methanol into a storage tank;

a recycle line configured to return unreacted gases from the condenser to the electrochemical reactor; and a methanol separation unit within the electrolyte circulation loop, configured to separate liquid methanol from the electrolyte and transfer it to a methanol storage tank.

9. The apparatus of claim 8, wherein methanol separation unit comprises at least one pervaporation hollow fiber membrane selective to methanol, said membrane comprising organic or inorganic polymers composited with 2D MXenes nanoflakes or 3D inorganic catalysts.

* * * * *